US005876230A

United States Patent [19]

Nishide et al.

[11] Patent Number: 5,876,230

[45] Date of Patent: Mar. 2, 1999

[54] CONNECTOR

[75] Inventors: Satoru Nishide, Yokkaichi; Takahiro Yoneda, Yokohama, both of Japan

[73] Assignee: Sumitomo Wiring Systems, Ltd., Japan

[21] Appl. No.: 796,191

[22] Filed: Feb. 7, 1997

[30] Foreign Application Priority Data

Feb. 9, 1996 [JP] Japan ..... 8-023823

[51] Int. Cl.[6] ..... H01R 13/627

[52] U.S. Cl. ..... 439/352

[58] Field of Search ..... 439/350–358, 439/489

[56] References Cited

U.S. PATENT DOCUMENTS 4,915,648 4/1990 Takase et al. ..... 439/353
4,927,374 5/1990 Batty ..... 439/352
4,993,067 2/1991 Matsumoto ..... 439/352
5,041,017 8/1991 Nakazato et al. ..... 439/352
5,183,410 2/1993 Inaba et al. ..... 439/489
5,362,248 11/1994 Hashiguchi et al. ..... 439/352

*Primary Examiner*—Hien Vu
*Attorney, Agent, or Firm*—Banner & Witcoff, Ltd.

[57] ABSTRACT

An electrical connector assembly includes two connector housings. One of the housings has a locking arm engageable with the other housing in the fully fitted condition. A spring member urges the housings apart unless in the fully fitted state. The locking arm is deflected to compress the spring member during fitting. In the fully fitted state the locking arm moves to an undeflected condition and the spring member consequently adopts a position which blocks further movement of the locking arm to the deflected state, thereby latching the connector housings with certainty against forcible separation on the engagement axis.

20 Claims, 3 Drawing Sheets

CONNECTOR

TECHNICAL FIELD

The present invention relates to a connector adapted to prevent semi-fitting whereby the two parts of the connector could be left in a state of incomplete engagement.

BACKGROUND TO THE INVENTION

JP 4-306575 discloses a pair of connector housings which are prevented from remaining in a semi-fitted position, and which are latched in a fully fitted condition.

The semi-fitting preventing means in such a connector comprises a spring member on one of the connector housings, which is resiliently deformable in a direction opposite to the fitting direction of the connector housings, this spring member protruding towards and colliding with the other connector housing so that if the fitting operation ends in the half fitted state, both the connector housings are separated due to the force applied by the spring member, and as a result the semi-fitted state can be easily detected.

Latching in the fitted state is provided by a locking arm provided on one of the connector housings, which can be engaged with the other connector housing.

In this conventional case, in the fitted and latched state there is a possibility of the locking arm being forcibly deflected in the releasing direction where a large external force is applied in the separation direction of the connector housings. This may cause the connector to separate in an unintended fashion.

The present invention has been developed taking into account the above problem and aims at maintaining with certainty the latched state of a pair of connector housings which are in a correctly fitted state by preventing the movement of a locking arm in the releasing direction.

SUMMARY OF THE INVENTION

According to the invention there is provided a connector assembly having a first connector housing and a second connector housing engageable therewith in an engagement direction, the first connector housing having a locking arm and the second connector housing having a spring member resiliently movable in the engagement direction and having a movement envelope, and a guiding member adapted to deflect the locking arm into said envelope, whereby in a semi-fitted state of said housings the locking arm is deflected by said guiding member into said envelope for contact with said spring member, movement of the connector housings in the engagement direction causing said locking arm to move said spring member in said envelope against resilient bias, and in the fully-fitted state the locking arm being movable to a latched condition outside said envelope, the spring member returning under resilient bias to prevent subsequent movement of said locking arm into said envelope.

The invention provides that if the fitting operation ends with the connector housings in a semi-fitted state, the connector housings will be separated due to the energizing force of the spring member, allowing the semi-fitted state to be easily determined.

Even if a force is applied to the correctly fitted connector housings in the direction of separation, the spring member remains in its envelope of movement and thereby prevents the locking arm from moving into the envelope. Accordingly, the latched state can be maintained with certainty.

Preferably said spring member comprises a spring having an abutment member on a free end thereof, and said locking arm is adapted for contact with said abutment member. Thus even if a force is applied to the correctly fitted connector housings in the direction of separation, the spring receiving member fits with the abutment member by making surface contact therewith, resulting in the prevention of movement of the locking arm towards the envelope. Accordingly, the latched state can maintained with certainty.

In a preferred embodiment the second connector further includes a stopping abutment for said abutment member to normally retain said abutment member in a condition whereby movement of said locking arm into said envelope from the latched condition is prevented.

Accordingly, the movement of the locking arm towards the envelope can be prevented with certainty except during assembly of the two connector housings.

Preferably the spring member includes a coil compression spring; this has the special characteristic of having its deflection and resilient return force in proportion. The adjustment and setting of the energizing force of the spring member with respect to the locking arm can thus be carried out easily. Since the coil compression spring can be housed within a long and narrow space without wastage, space can be saved. Preferably two coil springs are utilised, one on each side of the second connector housing. Such an arrangement gives even loading on the locking arm.

Preferably in the semi-fitted condition said spring member urges said locking arm laterally out of said envelope. Thus the movement of the locking arm to the latched position may be carried out smoothly; the mating faces may for example be tapered. The setting of the taper angle, the setting of the coefficient of friction, etc., can be carried out relatively easily with the configuration of the present invention to give a desired smooth operation.

Preferably a guiding member and the locking arm have mutually angled faces which engage and urge the locking arm towards the envelope under disengagement forces on the connector housings. Such an arrangement ensures that an increasing separation force is resisted since movement into the envelope is blocked by the spring member. The angle of inclination of the guiding member, the setting of the coefficient of friction etc., can be carried out relatively easily to give a desired effect.

In the preferred embodiment the locking arm protrudes from the first connector housing in the disengagement direction.

BRIEF DESCRIPTION OF THE DRAWINGS

Other features of the invention will be apparent from the following description of a preferred embodiment shown by way of example only in the accompanying drawings in which.

DESCRIPTION OF PREFERRED EMBODIMENT

An embodiment of the present invention is explained hereinbelow, with reference to FIGS. 1 to 4.

A connector of the present embodiment comprises a pair of mutually attachable and separable connector housings. A female connector housing 10, has inserted into therein a female terminal fitting 11, and a male connector housing 20 has inserted therein a male terminal fitting 21. Directions indicated in the following description are with respect to FIGS. 2 to 4.

Figure 1:
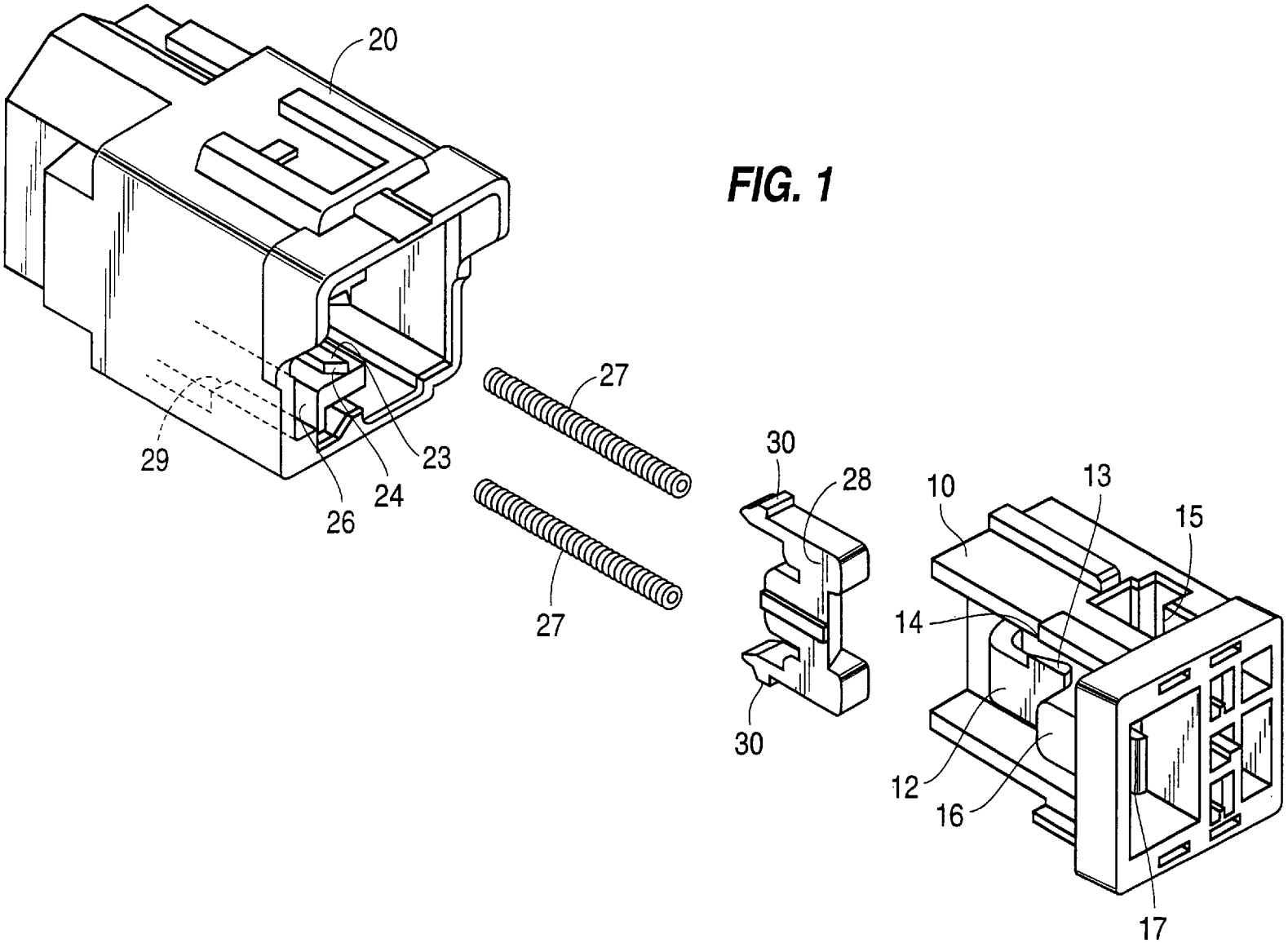
FIG. 1 is a diagonal view showing the disassembled state of an embodiment of the present invention.
Figure 2:
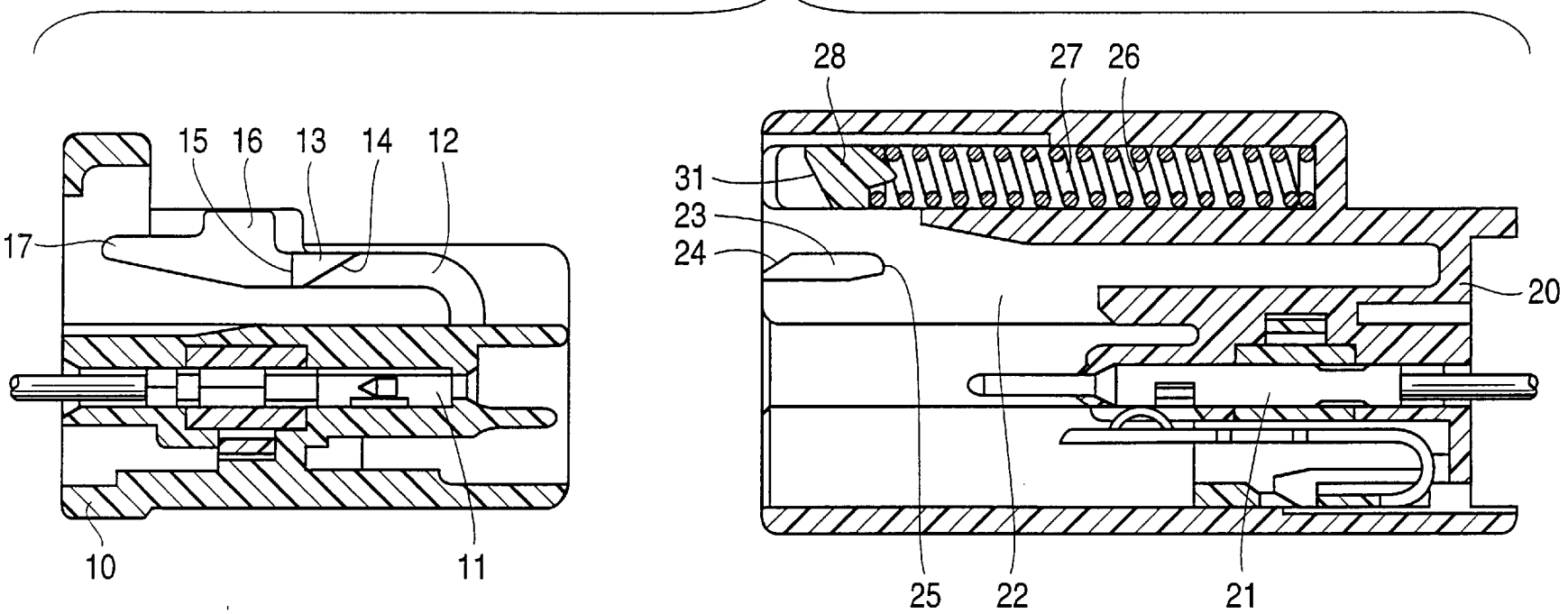
FIG. 2 is a cross-sectional view of the disassembled state.
Figure 4:
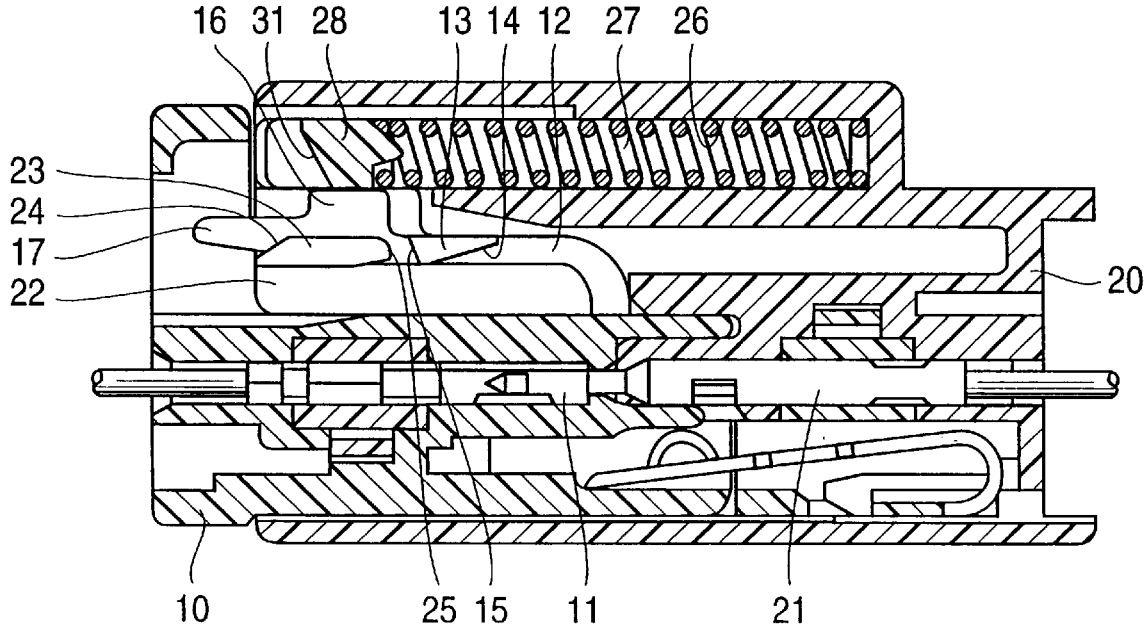
FIG. 4 is a cross-sectional view showing the fully fitted state.

The female connector housing 10 has a locking arm 12 formed in a unified manner on the face located at the upper side. The locking arm 12 serves to lock the female connector housing 10 and the male connector housing 20 in a fitted state. The locking arm 12 rises upwards from the side closer to the anterior end of the female connector housing 10 and projects in a posterior direction in an overhanging manner. That is, the locking arm 12 extends along the direction of fitting and removal of the connector housings 10 and 20, and can move resiliently in an up-down direction. When the connector housings 10 and 20 are in the separated state or in the correctly fitted state, the locking arm 12 is as illustrated in FIGS. 2 and 4. While the fitting operation is being carried out, the locking arm 12 deflects upwards due to a guiding member 23, in a manner to be described later. When the lock is to be released the locking arm 12 can be moved downwards under the guiding member. In each case the resilient restoring force urges the locking arm back to the mid-position.

Figure 3:
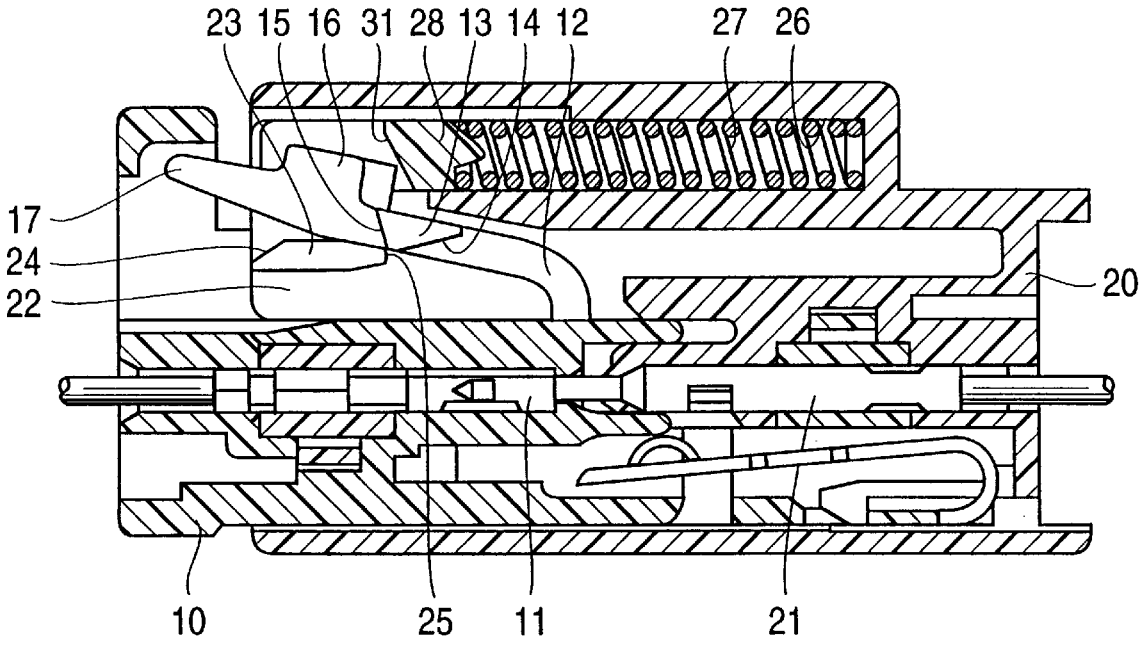
FIG. 3 is a cross-sectional view showing the stage immediately preceding the fitted state.

The locking arm 12 has a pair of guides 13 formed so as to protrude from either side thereof. These guides 13 are formed so that their thicknesses in the up-down direction (as seen in FIGS. 2–4) decreases progressively in the anterior direction. The lower face of each guide 13 consists of a guide face 14 that inclined upward in an anterior direction and that engaged against a guiding face 24 of a guiding member 23 when the fitting operation is commenced. The posterior faces of the guides 13 each includes a fitting face 15 for locking. These fitting faces 15 maintains the connector housings 10 and 20 in the correctly fitted state by engaging against a stopping face 25 of the guiding member 23 when the fully fitted state is reached.

When the fitting faces 15 for locking are in a fitted state with the stopping faces 25 of the guiding member 23, it becomes extremely difficult for the locking arm 12 to move in the lock releasing direction (the downward direction). Accordingly, the fitting face 15 for locking is not at a right angle with respect to the fitting direction, but constitutes a posteriorly inclined face that is in a slightly overhanging state, as viewed.

Moreover, the upper face of the locking arm 12 has a protruding spring receiving member 16 that fits during the fitting operation with a spring member 27 by entering a spring member housing chamber 26, to be described later. When the locking arm 12 moves in order to reach the locked state by fitting with the guiding member 23, this protruding member 16 enters a locking arm housing chamber 22. The upper face of the protruding member 16 is flat and is parallel to the fitting direction of the connector housings 10 and 20 when the locking arm 12 is in the locked state.

The posterior end of the locking arm 12 is an operating member 17 for allowing the operator to place a finger thereon when the lock releasing operation is to be carried out.

The male connector housing 20 is provided with a locking arm housing chamber 22 that opens out from the anterior face thereof. The side wall faces of the locking arm housing chamber 22 have long and narrow guiding members 23 formed so as to extend in an anterior-posterior direction (the fitting direction). The upper face of the anterior end of each guiding member 23 has a guiding face 24 formed so as to incline anteriorly in a downward direction. Due to these guiding faces 24 the locking arm 12 is forced upwards as the connector housings are engaged. As described, the posterior end face of each guiding member 23 constitutes a stopping face 25 that fits with the fitting face 15 of the locking arm 12. The connector housings 10 and 20 are maintained in the correctly fitted position since the movement of the locking arm 12 in the direction of removal is prevented by means of the fitting of the fitting face 15 and the stopping face 25 (FIG. 4).

The stopping face 25 of the guiding member 23 inclines at the same angle as the fitting face 15 of the locking arm 12 so that it becomes extremely difficult for the locking arm 12 to move inadvertently in the direction of removal (the downward direction) when the stopping face 25 is in a fitted state with the locking arm 12.

The spring member housing chamber 26 is formed above the locking arm housing chamber 22 so as to open out in the anterior direction. The anterior portions of the chamber 26 form a space for allowing resilient deformation of the spring member 27, the side portions connecting with the locking arm housing chamber 22. This space is within the envelope of movement of fitting members 28, to be described.

The chamber 26 houses two spring members 27 consisting of compression coil springs. These spring members 27 extend along an axial line in an anterior-posterior direction (the fitting direction). The anterior ends of these spring members 27 have a single fitting member 28 attached thereto. Due to this fitting member 28 the spring members 27 move resiliently in a uniform manner. Moreover, the inner side wall faces of the spring member housing chamber 26 have abutments 29 formed thereon. Both side faces of the fitting member 28 have protrusions 30 formed thereon (see FIG. 1). The spring members 27 normally maintain the protrusions 30 against the abutments 29 due to their resilient force.

The fitting member 28 moves in the anterior-posterior direction as the spring member 27 contracts and extends, and eventually adopts a position so as to cover the upper face of the locking arm 12 when the connector housings 10 and 20 are locked in the correctly fitted state (FIG. 4).

The fitting member 28 is arranged to be sufficiently long in the anterior-posterior direction so that it corresponds to the projecting member 16 of the locking arm 12. Moreover, the lower face of the fitting member 28 forms a plane face so as to be capable of making contact with the upper face of the spring receiving protruding member 16 in the locked state.

Furthermore, the anterior end face of the fitting member 28 forms a guiding face 31 so that the protruding member 16 of the locking arm 12 makes contact therewith when the locking arm 12 is forced to the upper position (FIG. 3). This guiding face 31 is formed in an overhanging shape so as to be inclined downwards, and is thus not at a right angle with respect to the fitting direction of the connector housings 10 and 20. This is in order to carry out the movement of the locking arm 12 in the locking direction in a smooth manner without risk of catching.

Next, the operation of the present embodiment is described. When both the connector housings 10 and 20 are fitted together, first the guide face 14 of the locking arm 12 fits with the guiding face 24 of the guiding member 23 and following its incline the locking arm 12 deflects upwards resiliently. When this happens, the protruding member 16 of the locking arm 12 pushes the fitting member 28 of the spring members 27 in a posterior direction. As a result, the spring members 27 are contracted, thereby causing a gradual increase of the force that opposes the fitting.

In the case where the fitting operation is terminated before the connector housings 10 and 20 reach the correctly fitted state, the locking arm 12 is pushed out of the locking arm housing chamber 22 by the elastic recovery force of the spring members 27, and the connector housings 10 and 20 are separated. Since this state is clearly not the correctly fitted state, the operator can accurately determine that the correctly fitted position was not achieved.

On the other hand if the fitting progresses and the connector housings 10 and 20 are fitted in the correctly fitted position, as shown in FIG. 3, the guide member 13 reaches the posterior end of the guiding member 23. Then, due to the elastic recovery force of the locking arm 12, the guided member 13 separates from the guiding member 23, and allows the locking arm 12 to move down and reach the locked state by causing the protruding member 16 to retreat into the locking arm housing chamber 22 (FIG. 4).

Here, the guiding face 31 with which the locking arm 12 makes contact is formed so as to be inclined in a downward direction with respect to a plane that is at a right angle to the direction of extension of the spring members 27 (that is, the direction in which the protruding member 16 pushes the fitting member 28). Consequently, a component of the energizing force of the spring members 27 acts on the locking arm 12 so as to push it downwards. Accordingly, the movement of the locking arm 12 to the locked position is carried out smoothly and accurately, resulting in superior operability.

Furthermore, the guiding face 31 is not formed directly on the spring members 27 but is formed on the fitting member 28 which is attached to the spring members 27 as a separate piece. As a result, when forming the guiding face 31, the material to be used, the angle of inclination, etc., can be decided upon without taking the function of the spring members 27 into consideration. Thus, compared to the case where a guiding face is formed directly on the spring member, the degree of freedom of design increases.

When the locking arm 12 moves to the locked position in this way, as shown in FIG. 4, the locking takes place as the fitting face 15 and the stopping face 25 of the locking arm 12 and the guiding member 23 fit together, and the connector housings 10 and 20 are maintained in the correctly fitted state. Moreover, the spring members 27 from which the locking arm 12 separates, return to the anterior end position due to their elastic recovery force and are stopped by the stopper 29.

In this state, the fitting face 15 and the stopping face 25 or the locking arm 12 and the guiding member 23 are not at a right angle to the fitting direction but are inclined with respect to it. As a result, in the case where an external separating force is applied to the connector housings 10 and 20, a force is applied that causes the locking arm 12 to be moved upwards. Due to the fitting member 28, the locking arm 12 is held down and the release of the connector housings is prevented, resulting in a locked state being maintained with certainty.

In the present embodiment, even in the case where, as described above, a force is applied in the upward direction on the locking arm 12 due to the separating force applied to the connector housings 10 and 20, the movement of the locking arm 12 in the upward direction is prevented. That is, the fitting member 28 gets positioned above the upper face of the locking arm 12 so as to cover it, thereby preventing the upward movement of the locking arm 12. As a result, there is no possibility of the fitting of the fitting face 15 and the stopping face 25 being released, and the connector housings 10 and 20 are maintained in a locked state by means of the locking arm 12.

Moreover, since the extent to which the fitting member 28 covers the locking arm 12 continues over a sufficiently long range in the fitting direction of the connector housings 10 and 20, even if, due to dimensional tolerance, there is an irregularity in the relative positioning of the fitting member 28 and the locking arm 12 in the fitting direction of the connector housings 10 and 20. Accordingly, prevention of upward movement of the locking arm 12 by the fitting member 28 is effected with certainty.

When the connector housings 10 and 20 are to be separated, the operating member 17 of the locking arm 12 is pushed hard and the locking arm 12 is moved downwards elastically. When this is done, the fitting of the fitting face 15 and stopping face 25 is released and the lock is released. The connector housings 10 and 20 may then be separated by passing the guide member 13 under the guiding member 23.

In the present embodiment, when in the locked state the fitting member 28 covers the locking arm 12 from above, the spring members 27 elastically come into contact with the stoppers 29. Consequently, the fitting member 28 is fixed in a specified position. As a result, compared to the case where the spring member loses its elastic force due to the its being in a free state, the upward movement of the locking arm 12 can be prevented with greater reliability.

Further, in the present embodiment, since a compression coil spring, which has the special characteristic of having its bending amount and elastic force in proportion, is used as the spring member 27, adjustment and setting of the energizing force of the spring member 27 with respect to the locking arm 12 can be carried out quite easily. This results in a higher degree of freedom of design. Moreover, since the compression coil spring can be housed within a long and narrow space without wastage, space can be saved and miniaturization of the female connector housing 10 is realized.

The present invention is not limited to the embodiments described above with the aid of figures. For example, the possibility described below also lie within the technical range of the present invention. Moreover, the present invention may be embodied in various ways other than those described below without deviating from the scope thereof.

(1) Although in the embodiment described above a compression coil spring is used as a spring member, in the present invention the configuration may equally be such that something other than a compression coil spring is used.

(2) Although in the embodiment described above the fitting member is attached to the anterior end of the spring member as a separate piece, in the present invention the configuration may equally be such that a fitting member is not used and the anterior end member of the spring member directly covers the upper part of the locking arm.

(3) Although in the embodiment described above the locking arm is provided on the female connector housing, the present invention can equally be applied in the case where the locking arm is provided on the male connector housing.

We claim:

1. An electrical connector assembly comprising a first connector housing and a second connector housing engageable with the first connector housing in an engagement direction through a semi-fitted state to a fully-fitted state, the first connector housing having a locking arm, the second connector housing having a spring and a fitting member at a free end of the spring for contact with said locking arm, said spring being resiliently movable in the engagement direction along a path, said fitting member having a tapered guide face for contact with said locking arm to urge said locking arm smoothly out of said path of said spring in the fully-fitted state, the second connector housing further having a guiding member adapted to deflect the locking arm into said path of said spring in a semi-fitted state of said housings for contact with said fitting member such that movement of the connector housings in the engagement direction causes said locking arm to move said fitting member against a resilient bias of the spring, and in the fully-fitted state the locking arm being movable to a latched condition outside said path of said spring, the fitting member returning under resilient bias of the spring to prevent return movement of said locking arm into said path of said spring, and said locking arm in said latched condition being movable to a release condition without moving in the path of the spring.

2. The electrical connector assembly according to claim 1 comprising two parallel coil compression springs, said fitting member bridging said springs.

3. The electrical connector assembly according to claim 1 wherein the second housing further includes an abutment for said fitting member to normally retain said fitting member in a condition whereby movement of said locking arm into said path of said spring from the latched condition is prevented.

4. The electrical connector assembly according to claim 1 whereby said locking arm protrudes from the first connector housing in the disengagement direction.

5. The electrical connector assembly according to claim 1 wherein in the fully-fitted conditions, said fitting member biases said locking arm to the latched condition.

6. The electrical connector assembly according to claim 1 wherein said guiding member is elongate in the engagement direction and has a tapered guide face adapted to urge said locking arm towards said path of said spring in response to relative movement in the engagement direction.

7. The electrical connector assembly according to claim 6 wherein said guiding member has a tapered guide face at both ends thereof, the guide faces being adapted to urge said locking arm towards said path of said spring in response to relative movement in the engagement direction and the disengagement direction.

8. The electrical connector assembly according to claim 7 wherein said locking arm includes guides having opposed angled faces for respective abutment with said tapered guide faces.

9. The electrical connector assembly according to claim 8 wherein said angled faces are adjacent to one another.

10. The electrical connector assembly according to claim 1 wherein said fitting member is adapted for contact with said first housing, thereby to urge said connector housings apart other than in the fully fitting state.

11. The electrical connector assembly according to claim 2 wherein the second housing further includes an abutment to normally retain said fitting member in a condition whereby movement of said locking arm into said path of said spring from the latched condition is prevented.

12. The electrical connector assembly according to claim 4 wherein in the fully-fitted condition, said fitting member biases said locking arm to the latched condition.

13. The electrical connector assembly according to claim 10 whereby said locking arm protrudes from the first connector housing in the disengagement direction.

14. The electrical connector assembly according to claim 10 wherein in the fully-fitted condition said fitting a member biases said locking arm to the latched condition.

15. A electrical connector assembly comprising a first connector and a second connector engageable with each other through a semi-fitted state to a fully-fitted state, the first connector having a locking arm, the second connector having a spring and a fitting member, said spring being resiliently movable along a path, the second connector further having a guide member to deflect said locking arm into engagement with said fitting member in a first position in the semi-fitted state so as to compress said spring when said connectors are moved toward the fully-fitted state, said guide member maintaining said locking arm in contact with said fitting member through the semi-fitted state and permitting said locking arm to move to a latched condition out of the path of said spring upon reaching the fully-fitted state, said fitting member being pushed by said spring to return to the first position to prevent movement of said locking arm into the path of the spring from said latched condition, and said locking arm being releasable from said latched condition without moving in the path of said spring.

16. The electrical connector assembly according to claim 15 wherein said fitting member has a tapered guide face for contact with said locking arm thereby to urge said locking arm smoothly out of said path of said spring.

17. The electrical connector assembly according to claim 16 comprising two parallel coil compression springs, said fitting member bridging said springs.

18. The electrical connector assembly according to claim 16 wherein the second housing further includes an abutment to normally retain said fitting member in a condition whereby movement of said locking arm into said path of said spring from the latched condition is prevented.

19. The electrical connector assembly according to claim 15 wherein said guide member and said locking arm each has a latching face which engages one another in the latched condition to prevent separation of the connectors.

20. The electrical connector assembly according to claim 19 wherein said latching faces are complementarily inclined to urge said locking arm toward said spring member upon movement of the connectors in a separation direction.

* * * * *